United States Patent [19]

Phelan

[11] 3,936,835

[45] Feb. 3, 1976

[54] DIRECTIVE DISK FEED SYSTEM

[75] Inventor: Harry Richard Phelan, Indialantic, Fla.

[73] Assignee: Harris-Intertype Corporation, Cleveland, Ohio

[22] Filed: Mar. 26, 1974

[21] Appl. No.: 454,910

[52] U.S. Cl. ..... 343/753; 343/779; 343/833; 343/840

[51] Int. Cl.[2] ..... H01Q 19/16; H01Q 21/26

[58] Field of Search ..... 343/779, 833, 753, 840

[56] References Cited

UNITED STATES PATENTS

| | | | |
|---|---|---|---|
| 3,308,468 | 3/1967 | Hannan | 343/779 |
| 3,774,223 | 11/1973 | Ehrenspeck et al. | 343/779 |

*Primary Examiner*—Eli Lieberman

[57] ABSTRACT

A multiple beam antenna having either a main reflector or a lens is illuminated by a feed system comprising a number of primary radiators such as dipole elements. Primary radiation from each dipole element reflects from the principal reflector to produce a different respective one of the multiple secondary beams in the remote field. A disk-shaped electrically conductive director is located in the primary radiation path near each primary radiator. Each director operates both to shape the primary pattern of its respective primary radiator directly, and also to excite parasitic radiation in neighboring primary radiators so as to produce a primary radiation pattern whose shape approximates a sector of a circle, thereby producing high illumination efficiency at the main reflector. The desired sector shape of primary pattern is achieved despite relatively close lateral spacing between adjacent primary radiators of the feed system. The close spacing enables achievement of high beam crossover level between adjacent secondary beams in the remote field.

21 Claims, 11 Drawing Figures

DIRECTIVE DISK FEED SYSTEM

BACKGROUND OF THE INVENTION

Figure 1B:
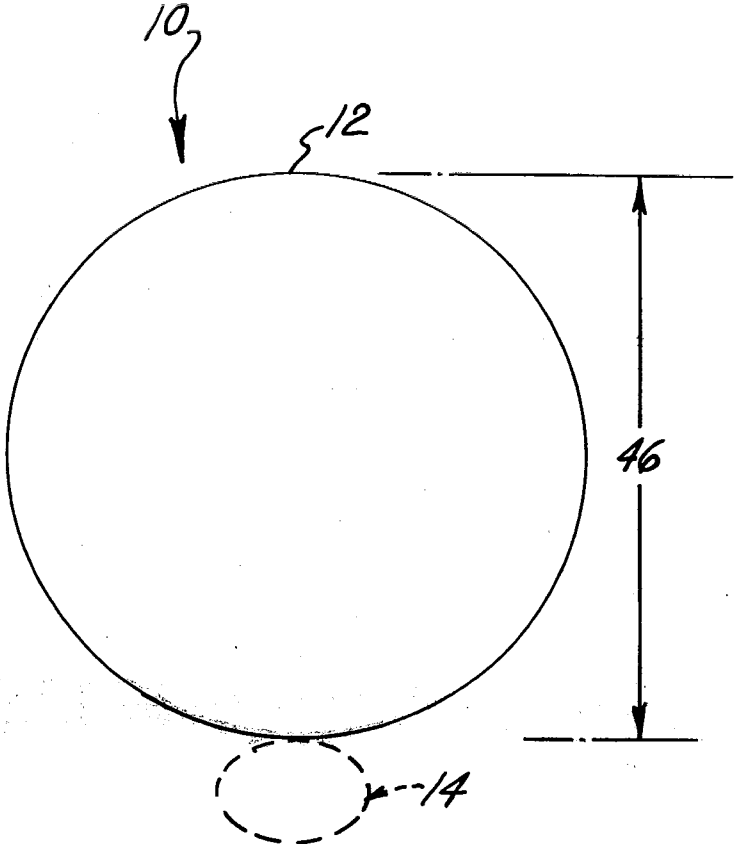

The field of this invention is reflector antennas or lens antennas for producing multiple beams, for example simultaneous multiple beams, without mechanically relocating the feed elements. Conventional feed systems for multiple beam antennas have often used horn antennas as feed elements. The horn antennas are clustered near the focal point of the main reflector or lens, whichever is used, and each horn antenna produces a primary radiation pattern illuminating the main reflector from a different point. This results in the multiple secondary beams which radiate into the remote field from the antenna as a whole.

An important objective in designing multiple beam antennas often is to obtain a beam spacing in the remote field of approximately one-half the beamwidth of an individual beam, where the term beamwidth is used here to indicate the spacing between halfpower points of an individual beam. When this design objective is obtained, the crossover loss at a beam crossover point, which is where the radiation pattern of one beam intersects the radiation pattern of an adjacent beam, is preferably about three decibels.

The beamwidth of each of the multiple beams in the remote field is determined primarily by the size of the main reflector expressed in wavelengths of the radiation. Consequently, for a fixed size of main reflector, the widths of individual beams in the remote field are fixed, and the beam crossover loss is determined almost entirely by the angular spacing between adjacent beams in the far field. This angular spacing between adjacent beams is in turn determined principally by the mechanical spacing between phase centers of the individual feed elements.

A troublesome problem of the prior art in producing a feed system for a multiple beam antenna is the difficulty of bringing the phase centers of the bulky individual feed elements close enough together while still maintaining efficient primary illumination patterns for the main reflector or lens.

A very desirable primary radiation pattern for illuminating a reflector or lens is a radiation pattern shaped like a piece of pie, that is, one which is a sector of a circular disk. This idealized shape of pattern has uniform radiation intensity throughout an angular sector, and zero intensity outside of that angular sector, which implies straight steep sides defining the edges of the pattern. In three dimensions the pattern has conical sides.

When horn antennas are used as the primary feeds in a multiple beam antenna, it is found that if the horns are made small enough to be mounted close enough together to obtain a close angular secondary beam spacing in the remote field, the primary radiation patterns from the individual horn elements are too broad to provide efficient illumination of the main reflector. This results in degraded over-all antenna efficiency. Either a significant amount of energy from the horns passes around the edge of the main reflector, or else, when the reflector is made large enough to intercept most of the primary energy from the feed horn, the main reflector is excessively large and expensive and/or the beamwidth in the remote field is so narrow that adjacent beams cross over at a point whose power level on either beam is weaker than the desired 3 dB crossover level. Alternatively, when the individual horn elements are each made large enough to provide good illumination of the main reflector, the horns must be spaced so far apart because of their size that their phase center spacing is too large to obtain close secondary beam angular spacing, with its attendant low crossover loss.

SUMMARY OF THE INVENTION

The present invention is an antenna system utilizing either a main reflector or a main lens illustrated by a cluster of primary feed elements that are spaced closely enough together to provide low beam crossover loss of the remote field beams, but in which the feed elements nevertheless also provide primary radiation patterns which approximate the optimum sector shape to an unusually high degree and therefore, provide high illumination efficiency.

In the antenna of this patent, feed elements or primary radiators are employed whose lateral dimensions are small. The elements are preferably either dipoles or open ended waveguides, although other types of feed elements are also usable. The feed elements are disposed closely enough together to produce the low beam crossover loss that is desired. The radiation patterns with which these primary radiator elements illuminate the main reflector or lens are shaped to have a relatively blunt nose and relatively steep sides, the shaping being accomplished by mounting an electrically conductive disk in front of each of the primary radiator elements and less than a wavelength away from the primary radiator elements. Thus, the disk is less than a wavelength away from the dipole or the open end of a waveguide. The shaping of the primary radiation patterns to have a sector shape for efficient aperture illumination by each feed element is obtained by a combination of two effects. First, each of the conductive disks serves as a director which tends to shape the basic dipole or waveguide element pattern. Second, other feed elements surrounding the driven feed element are excited parasitically, and they reradiate energy which combines with energy radiated from the directly excited element to shape the element radiation pattern further. The parasitic excitation is achieved in neighboring elements with appropriate phase and amplitude by transferring energy through electric and magnetic fields from the disk director and primary radiator of the feed element under discussion to the disk directors and primary radiators of the surrounding feed elements. The open end of a waveguide, although partaking somewhat of the characteristics of a horn antenna element, can be much smaller than the horn antenna elements that are ordinarily used to feed multiple beam antennas, and therefore the feed elements can be spaced closer together without incurring physical interference between adjacent feed elements.

Disk directors have been used in front of horn antennas in the prior art. But in the present antenna, open-ended waveguides are employed instead of horns, and they are clustered in a group for use as a feed for a main reflector or lens, and the shape of the radiation pattern is controlled to be shaped like an angular sector of a circular disk to a great extent, by proportioning the disk directors to create appropriate parasitic radiation in surrounding antenna elements of the feed cluster.

Accordingly, one object of the present invention is to provide a multiple beam antenna having a main reflector or lens for redirecting feed radiation into a plurality of remote field beams, and including a multiple-element feed system in which the feed elements are spaced apart less than 1.1 wavelength, and in which a disk-shaped electrically conductive director is located immediately in front of each feed element for transversely coupling electromagnetic energy fields among the feed elements for parasitic excitation, whereby both a high beam crossover level and a high aperture efficiency are simultaneously achievable.

Another object of the present invention is to provide an antenna for producing multiple beams in the remote field which has both low loss due to beam crossover and high aperture illumination efficiency from its feed system.

A further object is to provide a multiple beam antenna having high aperture efficiency because of desirable primary feed radiation patterns and in which, nevertheless, adjacent secondary beams can be angularly spaced closely together in the far field so as to achieve low beam crossover loss.

Still another object is to provide an antenna as above and in which the feed radiators are dipole antennas having disk-shaped directors.

Another object is to provide an antenna as above and in which the feed elements are open ended waveguides having a conductive disk director mounted in front of each waveguide.

A still further object of the present invention is to provide an antenna as above and in which primary feed patterns which approximate the shape of a sector of a circle are produced by the effects of disk-shaped director elements that affect the direct radiation from the feed element with which they are associated and which also produce, by mutual coupling, parasitic radiation from neighboring feed elements of the feed cluster.

LIST OF FIGURES

Figure 1A:
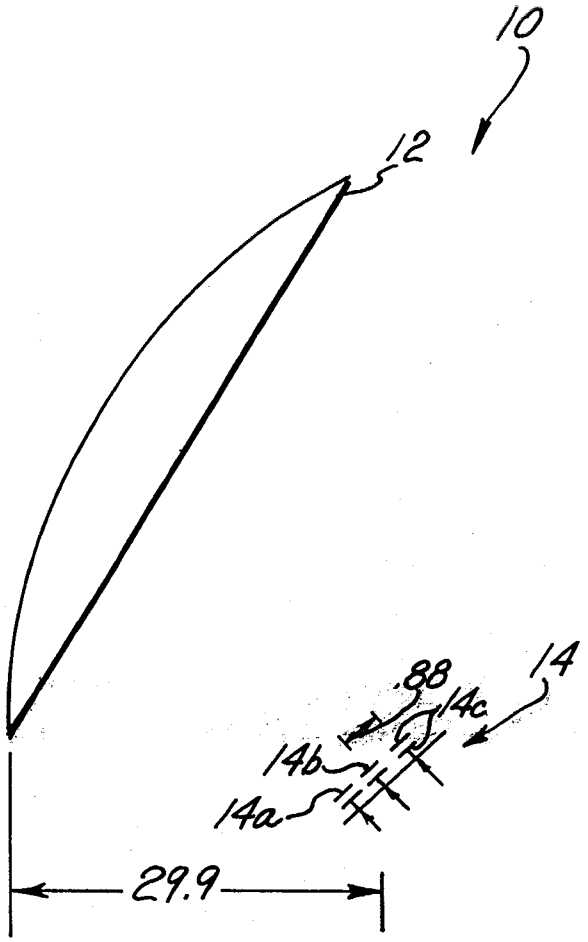
Figure 2:
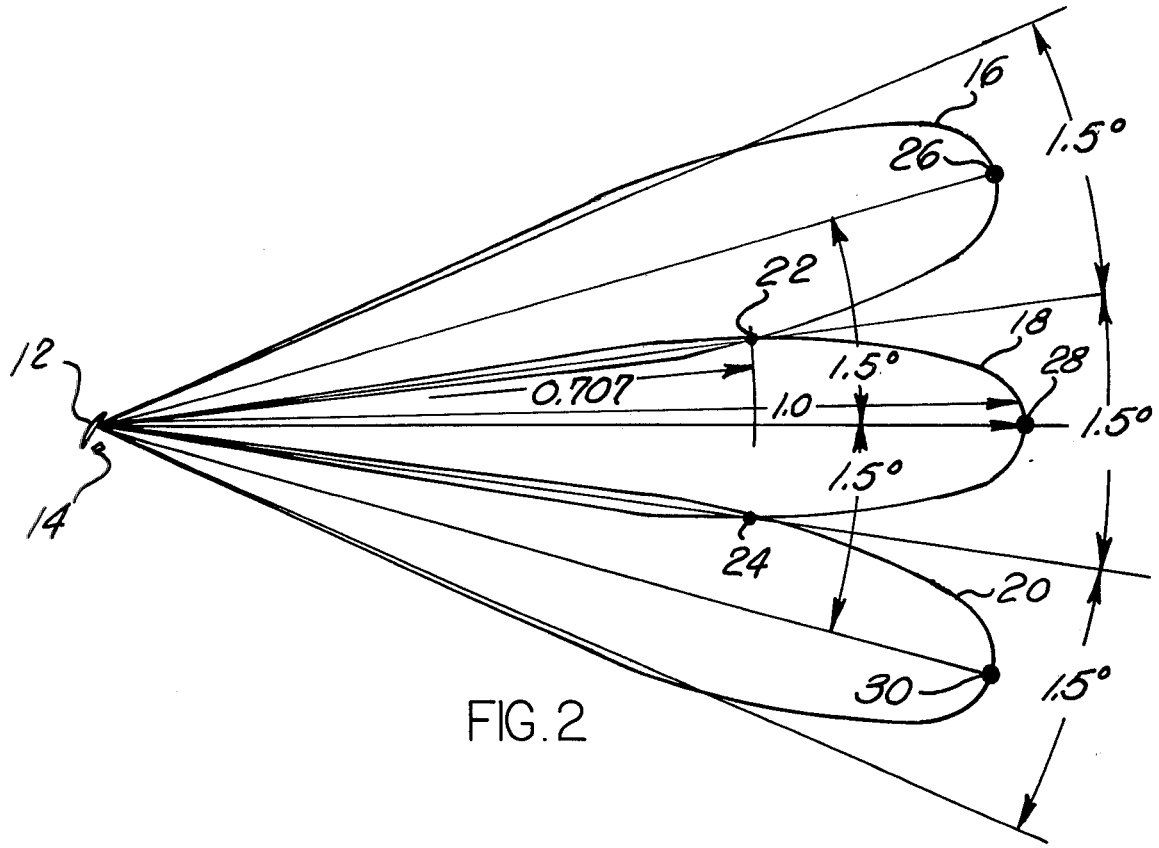
Figure 3A:
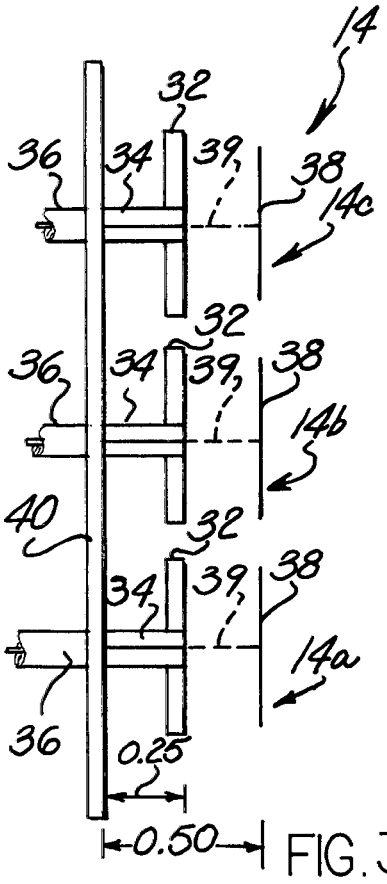
Figure 3B:
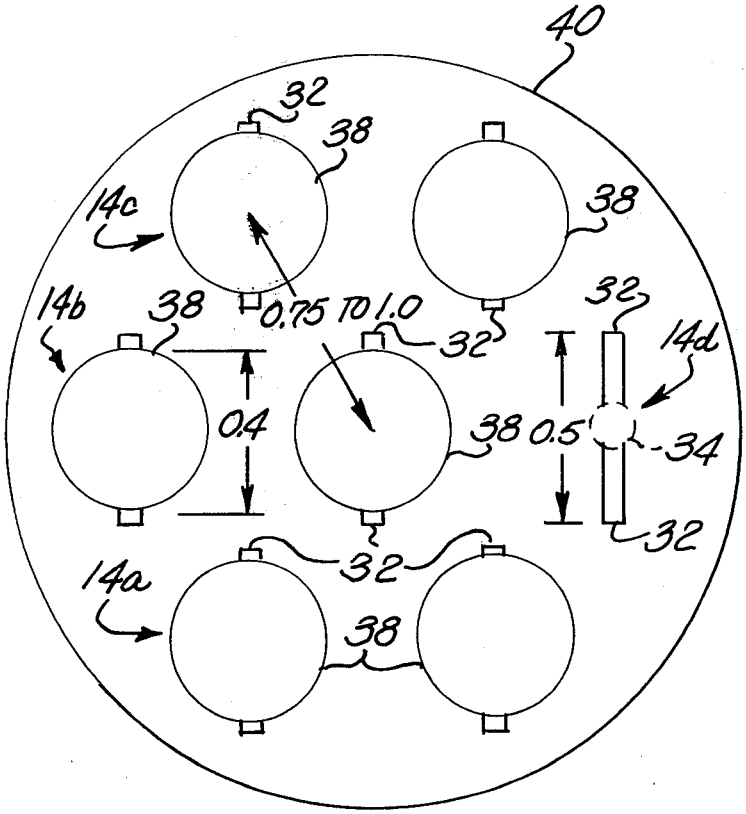
Figure 3C:
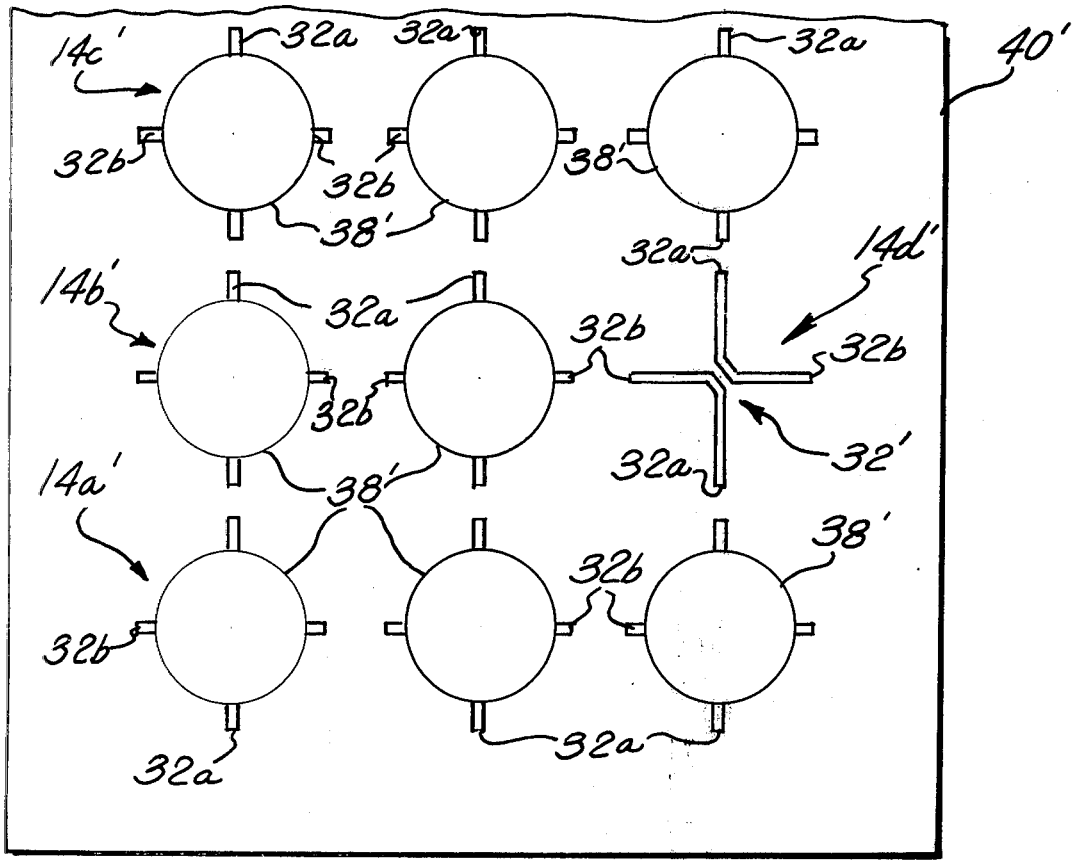
Figure 4:
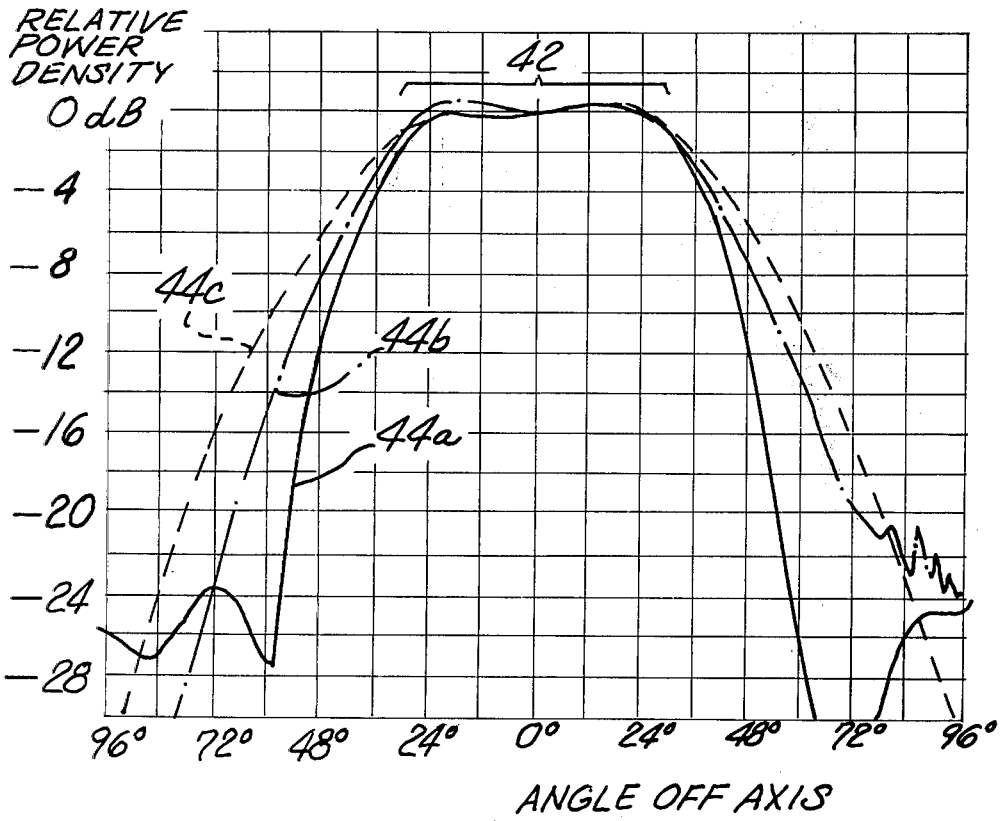
Figure 5A:
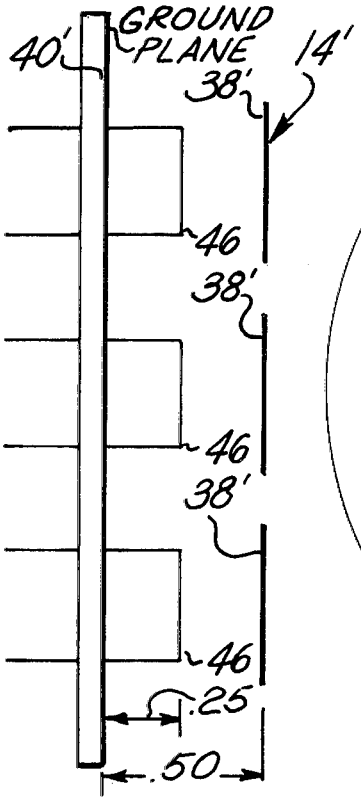
Figure 5B:
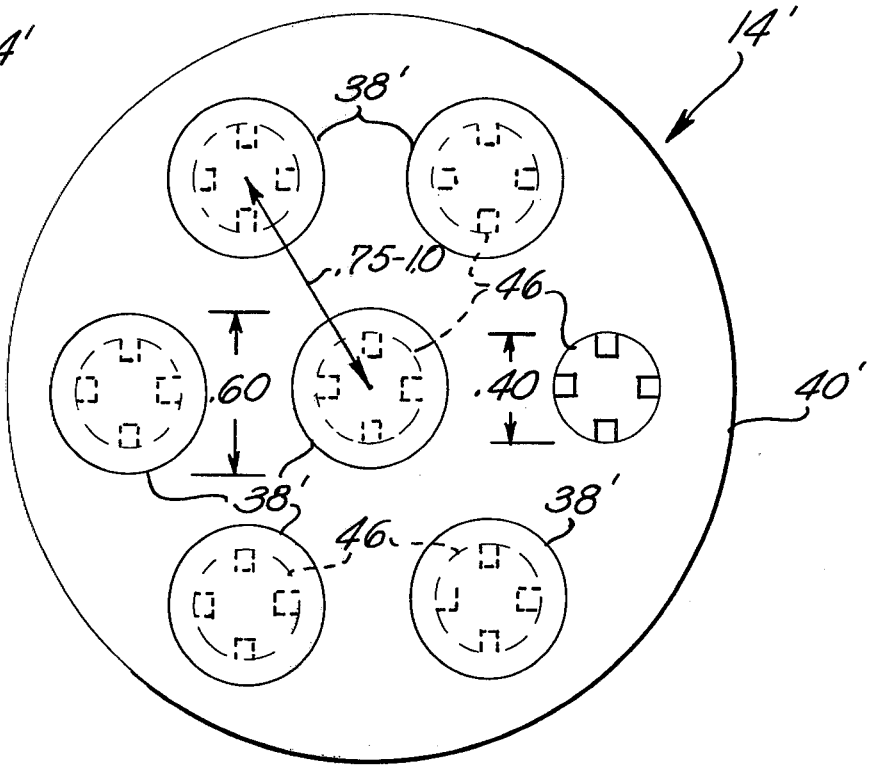
Figure 6A:
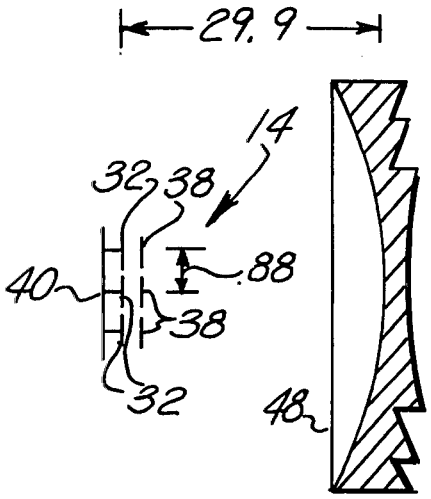
Figure 6B:
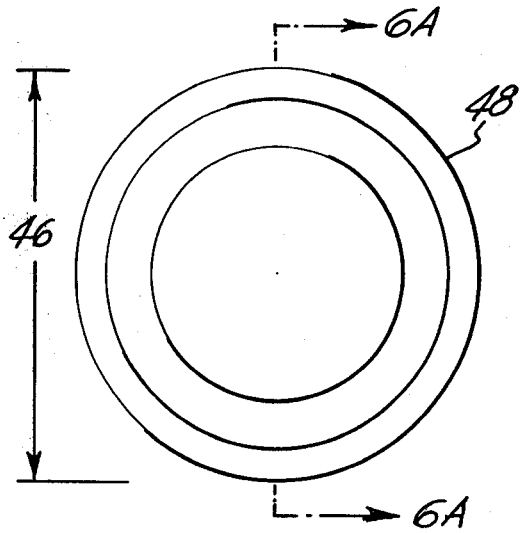

Other objects and features of the invention will become apparent upon consideration of the accompanying description and figures, in which:

FIG. 1A is a side view of a preferred embodiment of the multiple beam antenna, FIG. 1B is a front view of the offset-fed paraboloidal antenna of FIG. 1A, FIG. 2 shows electric field strength radiation patterns, in the remote field, of three overlapping secondary beams produced by the entire antenna, with the angular beamwidths and spacings between beams greatly exaggerated, FIG. 3A is a side view of a dipole feed system for the antenna, FIG. 3B is a front view of the feed system of FIG. 3A, FIG. 3C is a front view of a crossed-dipole feed system for the antenna, FIG. 4 shows primary radiation patterns produced by directly exciting one feed element while it is arrayed with other feed elements that are only parasitically excited, FIG. 5A is a side view of an open-ended waveguide feed system for the antenna, FIG. 5B is a front view of the feed system of FIG. 5A, FIG. 6A is a cross section of a lens embodiment of the invention, and FIG. 6B is a front view of the lens embodiment of FIG. 6A.

DESCRIPTION

A preferred embodiment of the invention is an antenna for producing multiple beams in the remote field by utilizing a main paraboloidal reflector which is fed from an offset focus position by a cluster of individual feed elements, each of which produces a primary radiation pattern that results in one of the secondary beams of the remote field. A side view of the entire antenna, which is generally indicated by reference numeral 10, is shown in FIG. 1A. It includes a paraboloidal reflector 12 which is illuminated by a feed assembly 14 that consists of a pluality of individual feed elements 14*a*, 14*b*, 14*c*, etc.

Each feed element 14*a*, etc., is itself an antenna, and each feed element illuminates the main reflector 12 with primary feed energy in a radiation pattern. It is desirable for the primary feed elements to propagate energy more or less uniformly in all directions in which the main reflector 12 will intercept the energy and reflect it, but not to radiate any energy in directions which would miss the main reflector 12. This ideal is not completely achievable, but should be approached as closely as possible to produce high aperture illumination efficiency. The feed cluster 14 is located near a geometrical focus of the paraboloid of reflector 12, the distance from the back of the paraboloid to the focus being indicated on FIG. 1A as 29.9 wavelengths in the interest of providing a numerical example. In the example, the inter-element spacing between centers of the feed elements 14*a*, 14*b*, etc. is 0.88 wavelength.

The feed cluster 14 is offset below the paraboloidal reflector 12, as shown in a front view of the antenna, FIG. 1B. A vertical projection of the paraboloidal reflector may be, for example, 46 wavelengths high, this number defining approximately the aperture size of the antenna in a vertical direction. The ratio of focal length to vertical aperture size is then approximately 0.325.

The antenna of FIGS. 1A and 1B is suitable for producing a multiplicity of beams in the remote field, adjacent beams being only one and one-half degrees apart angularly. Each beam has 1.5° half-power beamwidth. The adjacent beams overlap each other at a point where the power level of each beam is 3 dB less than the power level at the nose or maximum power of the beam, intersecting at half-power points. The beam crossover loss is therefore 3 dB.

The invention is equally applicable to other types of reflector antennas such as center-fed paraboloidal reflectors, Cassegrainian antennas, and Gregorian antennas.

The remote field radiation patterns of three secondary beams from the multiple beam antenna are shown to a greatly exaggerated angular scale in FIG. 2 to illustrate the crossover loss, which is important to the purpose of this invention. Although the beams and their spacings are drawn 15° wide, they are intended to represent beamwidths and beam spacings of only 1.5°, and are so labeled in FIG. 2. The electric field intensity radiation patterns 16, 18, and 20, which correspond to the feed elements 14*a*, 14*b*, 14*c* respectively, are shown crossing each other at points 22 and 24, which are half-power points at which the power density from each beam is 3 dB less than the power density of the beam at its center point such as point 26. The 1.5° angular spacing between the center points 26 and 28 and between the center points 28 and 30 is determined by the transverse spacing between phase centers of the feed elements 14*a*, 14*b*, and 14*c*, which is shown in FIG. 1A as being 0.88 wavelength in the present example.

The individual feed elements 14*a*, 14*b*, etc. of the feed group are shown to a larger scale in FIGS. 3A, 3B, and 3C for a preferred embodiment which uses dipoles as the primary radiators. The arrangement of element antennas 14*a*, 14*b*, etc. can be a circular array as in FIG. 3B, a rectangular grid array as in FIG. 3C, or some other configuration. Each element antenna, such as antenna 14*a*, has a half-wave dipole 32, a balun 34 for feeding the dipole 32, and a coaxial input line 36 for feeding the balun 34. Supported in front of the dipole 32 is a disk-shaped director 38 which can be mounted either by dielectric supports (not shown) or by metallic supports (not shown) extending outwardly along a centerline 39 of the balun 34. The dipole 32 is preferably one-quarter wavelength from a ground plane 40 over which all of the feed elements 14*a*, 14*b*, etc. are mounted. The disk director 38 is spaced less than one-half wavelength and preferably only one-quarter wavelength in front of a primary radiator 32.

In FIG. 3B one element antenna 14d is drawn with the director 38 removed in order to show the dipole 32. The disk directors 38 are preferably 0.4 wavelength in diameter, as shown in FIG. 3B, and the individual feed elements are preferably spaced between 0.75 and 1.0 wavelength apart, (less than 1.1 wavelength).

The disk directors 38 form, in cooperation with the ground plane 40, a partially enclosed cavity which is excited by the dipole 32. Electromagnetic fields established by the dipole 32 and the disk director 38 couple some of the energy that enters at the coaxial input of a particular feed element, from that feed element sideways to other feed elements of the feed cluster 14.

A rectangular grid arrangement of element antennas, FIG. 3C, illustrates one possible variation of the invention. FIG. 3C is drawn with two dipole antennas at each element antenna to illustrate another embodiment of the primary radiators that permits excitation by circular polarization. With the feed elements constructed and spaced as shown in FIG. 3C, the radiation patterns produced by only one directly excited element antenna, when mounted in a terminated array so as to produce parasitic radiation from its neighboring element antennas, is as shown in FIG. 4. This is a rectangular coordinate graph of the principal E plane, H plane and 45° plane patterns 44*a*, 44*b*, 44*c*, respectively, and illustrates the unusually flat nose 42 of the patterns. All of the patterns 44*a*, 44*b*, 44*c* have relatively steep sides considering the small transverse dimensions, about one-half wavelength, of the feed element producing the pattern. These patterns were measured with one element antenna directly excited and the other element antennas of the feed array of FIG. 3C terminated in their driving point impedances.

One element antenna 14d′ of FIG. 3C is drawn with its diskshaped director removed to show the crossed dipoles 32′, which are the primary radiators, 32*a* and 32*b*. One pair of dipoles 32*a* is longer than the other pair 32*b*, so as to produce different reactances and hence currents of different phases in the two pairs, for circular polarization.

The radiation patterns of FIG. 4, with their flat noses and steep sides, are highly desirable patterns for illuminating the paraboloidal reflector 12 of FIGS. 1A and 1B because, for a properly selected size of reflector, very little energy spills around the edges of the reflector, and strong relatively uniform radiation impinges upon the reflecting surface. Good aperture illumination efficiency is achieved. An over-all antenna efficiency exceeding 72 percent can be achieved with the primary radiation patterns of FIG. 4 illuminating the reflector 12 as in FIG. 1.

These desirable radiation patterns are produced despite what is ordinarily a great handicap, namely the close spacing between element antennas of the feed cluster. As described above, this close spacing of the feed elements is required in order to place the remote field beams 16, 18, 20, closely enough together to have approximately 3 dB crossover loss as shown in FIG. 2. In the remote field of the multiple beam antenna, the angular separation between adjacent individual secondary beams is directly proportional to the separation between the phase centers of adjacent individual feed elements which provide the primary radiation. Close lateral spacings of the phase centers of the feed elements results in close angular spacing of the multiple beams in the remote field.

Although in discussing the feed system and parasitic radiation, one feed element at a time has been said to be excited and the feed elements surrounding it have been described as being parasitically excited, it should be clear that more than one or all of the feed elements can be excited simultaneously, and often are, and that the foregoing description of direct excitation and parasitic excitation still applies with respect to the energy from each of the feed elements. It is well known that the total radiation from the entire feed system is obtained by superposition of the effects due to individual feed elements, where the system is linear, as is usually the case.

The dipoles 32 need not be the cylindrical type as shown in the figures, but can instead be triangular dipoles, sleeve dipoles or other types. Baluns other than the slotted coaxial type shown can, of course, be employed.

In another embodiment of the feed array, which is shown in FIGS. 5A and 5B as 14′, the elements are fed by open-ended ridgeloaded circular waveguides 46. Each waveguide 46 protrudes about one-quarter wavelength through a feed system ground plane 45. Supported in front of the open end of each of the waveguides 46 is a disk director 38′. The disk director may be supported by a dielectric support or by a conductive structure such as a metallic rod, provided the conductive structure is arranged to produce very little interference with the electric and magnetic fields being transmitted from the open ends of the waveguides. An axial rod would suffice. In a front view, FIG. 5B, of the embodiment employing open-ended waveguides, one of the feed elements is drawn with its director 38′ omitted, in order to show more clearly an end view of the waveguide 46.

The centers of the antenna feed elements of FIG. 5B are spaced apart 0.75 to 1.0 wavelength in this embodiment, as an example. The disk diameter is preferably about 0.60 wavelength when the circular waveguide diameter is about 0.40 wavelength. The open-ended waveguides 46 radiate energy toward and around the disk directors 38′, which serve as boundaries of loosely defined cavities between themselves and the ground plane. At the same time, energy from each of the waveguides 46 is coupled to other primary radiators and disk directors 38′ surrounding the one with which each waveguide is respectively associated, so that the other feed elements produce parasitic reradiation of the energy which comes to them transversely from a neighboring feed element. The individual feed elements, each comprising an open waveguide 46 and a disk director 38', can be spaced closely enough together, because of their small transverse size, to achieve a 3 dB beam crossover loss in the remote field of the antenna as a whole. Moreover, the feed elements achieve this close beam spacing without sacrificing good aperture illumination efficiency, because the presence of the disk directors 38' in array causes the radiation pattern of each feed element to be relatively sector-shaped, that is, blunt-nosed and steep-sided.

The waveguides 46 need not be round. Square, rectangular, or other cross-sectional shapes of waveguides can be employed to practice the invention.

Where, in some circumstances, it is desirable to use a small horn as a primary radiator instead of merely the open end of a waveguide, the advantages of the present invention are still available. The smaller size of horn which is usable when a director disk is employed with the horn in proximity with other horns, permits the horns to be mounted closer together than in feed systems of the prior art. In both the dipole embodiment of FIG. 3A and the waveguide embodiment of FIG. 5A, the feed system ground plane can be curved instead of flat, if desired, to minimize scan loss in a multiple beam antenna.

Where the main radiation redirecting means is a lens instead of a paraboloidal reflector, the feed array 14 can be the same as those which were described above, but the feed array is preferably mounted on the principal axis of the main lens. FIGS. 6A and 6B show a lens embodiment of the present multiple beam antenna for producing 1.5° half-power beamwidths with 3 dB crossover loss. A Fresnel lens 48 intercepts most of the energy radiated by the primary feed elements of the cluster 14, which are located near the focus of the lens 48. The lens 48 redirects the energy that it receives from each of the feed elements to collimate the energy and provide a plurality of secondary beams spaced 1.5° apart in the far field, each secondary beam corresponding to one of the feed elements of the feed cluster 14. As was described above, efficient illumination of the main redirector, in this case the zoned lens 48, is achievable from the feed elements of the array 14 because of the directors 38. Collectively, the directors 38 operate to produce blunt-nosed, steep-sided primary beams for illuminating the lens 48. At the same time, the small transverse dimensions of the feed elements permit them to be spaced closely together, so that the angular spacing between adjacent secondary beams in the remote field can be small enough to limit the crossover power loss to 3 dB. In a numerical example of the lens embodiment of the invention shown in FIGS. 6A and 6B, the focal length is 29.9 wavelengths, the interelement spacing is 0.88 wavelength, and the outside diameter of the zoned lens 48 is 46 wavelengths.

The lens 48 need not be a natural dielectric, nor need it be a zoned wide angle scan lens as shown in FIGS. 6A and 6B. To provide a few alternative examples, a single zone lens, or an artificial dielectric lens, or a waveguide array lens could equally well be employed to practice the invention.

If desired, the feed system ground plane can be curved to minimize scan loss in the multiple beam antenna. The directors 38 can be constructed of a conductive mesh or wires, instead of being solid as shown in the preferred embodiment. Of course, the number of feed elements can be greater or smaller than the number shown in the figures. If the main reflector or lens is unsymmetrical, the disks 38 can advantageously be shaped differently, for example in an oval shape, to produce primary radiation patterns that are better fitted to the shape of the main reflector than the substantially circular patterns of the preferred embodiment.

It is universally known in the prior art that a radio receiving antenna, by reciprocity, ordinarily functions the same way as a transmitting antenna of the same structural characteristics. Consequently, the foregoing description of a transmitting antenna is equally applicable to a receiving antenna except that power flows in the reverse direction. The present invention is therefore suitable for both transmitting electromagnetic waves and receiving them, and the patent is intended to apply to both.

I claim:

1. A multiple-beam antenna comprising a collimating means for redirecting electromagnetic energy; and a feed array including a feed-system ground plane, a plurality of element antennas spaced apart 0.7 to 0.9 wavelength for illuminating said collimating means by respective feed energy paths, each of said feed element antennas having a primary radiator spaced about one-fourth wavelength from said ground plane and a generally circular director, said director being disposed on and transverse to the respective feed energy path and about one-quarter wavelength from the respective primary radiator and proportioned for mutual electric and magnetic coupling with others of said directors for inducing parasitic radiation to produce a substantially angular sector-shaped feed radiation pattern when one respective primary radiator is directly excited in array.

2. A multiple-beam antenna as defined in claim 1 and wherein said collimating means comprises reflector means.

3. A multiple-beam antenna as defined in claim 1 and wherein said collimating means comprises lens means.

4. A multiple-beam antenna as defined in claim 3 and wherein said lens means comprises dielectric lens means.

5. A multiple-beam antenna as defined in claim 3 and wherein said lens means comprises artificial lens means.

6. A multiple-beam antenna as defined in claim 1 and wherein said primary radiator is a dipole antenna.

7. A multiple-beam antenna as defined in claim 1 and wherein said primary radiator is an open-ended waveguide.

8. A multiple-beam antenna as defined in claim 1 and wherein said electrically conductive director is disk-shaped.

9. A multiple-beam antenna as defined in claim 1 and wherein said primary radiators are one-quarter wavelength from said ground plane and said directors are one-quarter wavelength from said primary radiators.

10. A multiple-beam antenna as defined in claim 1 and wherein said collimating means comprises an offset-fed paraboloidal reflector and wherein said feed array is located proximate the offset focus point of said reflector.

11. A multiple-beam antenna as defined in claim 1 and wherein said primary radiator is an open-ended waveguide of about 0.4 wavelength transverse dimensions, the open end of said waveguide being about one-quarter wavelength from said ground plane, and wherein said director is about 0.6 wavelength in transverse dimensions.

12. A multiple-beam antenna as defined in claim 1 and wherein said ground plane comprises a non-planar curved surface.

13. A multiple-beam antenna as defined in claim 1 and wherein said primary radiator comprises crossed dipoles arranged for excitation of differing phases to produce circularly polarized radiation.

14. A multiple-beam antenna as defined in claim 1 and wherein said element antennas are arrayed on at least one concentric circle in a plane parallel to said ground plane.

15. A multiple-beam antenna as defined in claim 1 and wherein said element antennas are arrayed in rows and columns in a plane parallel to said ground plane.

16. A multiple-beam antenna as defined in claim 1 and wherein said collimating means comprises electromagnetic lens means.

17. A multiple-beam antenna according to claim 1 wherein said primary radiator is a half-wave dipole antenna parallel to said ground plane.

18. A multiple-beam antenna according to claim 1 wherein said director is a substantially circular conductive sheet of about 0.4 wavelength diameter.

19. A multiple-beam antenna according to claim 17 wherein said director is a substantially circular conductive sheet of about 0.4 wavelength diameter.

20. A multiple-beam antenna according to claim 1 wherein said feed array is spaced by several wavelengths from said collimating means and oriented to as to illuminate said collimating means.

21. A multiple-beam antenna comprising a parabolic reflector for redirecting electromagnetic energy; and a feed array including a feed-system ground plane, a plurality of element antennas spaced apart less than 1.1 wavelength for illuminating said collimating means by respective feed energy paths, each of said feed element antennas having a primary radiator spaced about one-fourth wavelength from said ground plane and a director, said director being disposed on and transverse to the respective feed energy path and about one-quarter wavelength from the respective primary radiator and proportioned for mutual electric and magnetic coupling with others of said directors for inducing parasitic radiation to produce a substantially angular sector-shaped feed radiation pattern when one respective primary radiator is directly excited in array, wherein said parabolic reflector has a main aperture diameter of 46 wavelengths such that a half power beamwidth of 1.5° is provided and said parabolic reflector has a ratio f/D of 0.325 where f is the focal length of said parabolic reflector and D is the aperture diameter thereof and said element antennas are spaced apart 0.88 wavelengths.

* * * * *